US006609700B2

(12) United States Patent
Leimer

(10) Patent No.: US 6,609,700 B2
(45) Date of Patent: Aug. 26, 2003

(54) VALVE SEAL ASSEMBLY WITH SPRING FINGER RETAINER

(75) Inventor: Mark Alan Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/871,052

(22) Filed: May 31, 2001

(65) Prior Publication Data

US 2002/0179877 A1 Dec. 5, 2002

(51) Int. Cl.[7] ..... F16K 31/44

(52) U.S. Cl. ..... 251/214; 251/337; 123/188.6; 277/502

(58) Field of Search ..... 251/214, 337; 123/188.6; 277/502

(56) References Cited

U.S. PATENT DOCUMENTS

| | | | | | |
|---|---|---|---|---|---|
| 2,157,866 | A | | 5/1939 | Robertson et al. | |
| 2,157,867 | A | | 5/1939 | Robertson et al. | |
| 2,878,799 | A | | 3/1959 | Brenneke | |
| 3,333,578 | A | | 8/1967 | Muller | |
| 3,379,445 | A | * | 4/1968 | Fisher | 277/178 |
| 3,498,621 | A | * | 3/1970 | Wilson | 277/152 |
| 3,531,134 | A | | 9/1970 | Kammeraad | |
| 3,771,800 | A | * | 11/1973 | Wilson et al. | 277/187 |
| 3,829,105 | A | | 8/1974 | Kammeraad | |
| 4,773,363 | A | * | 9/1988 | Stritzke | 123/188 |
| 4,811,704 | A | | 3/1989 | Boehmer et al. | |
| 4,822,061 | A | * | 4/1989 | Kammeraad | 277/181 |
| 4,909,202 | A | * | 3/1990 | Binford et al. | 123/188 |
| 4,947,811 | A | | 8/1990 | Binford | |
| 5,237,971 | A | | 8/1993 | Worsley | |
| 5,553,869 | A | * | 9/1996 | Stamback | 277/33 |
| 5,584,271 | A | * | 12/1996 | Sakata | 123/188.6 |
| 5,775,284 | A | * | 7/1998 | Kirchner et al. | 123/188.6 |
| 5,846,391 | A | * | 12/1998 | Friese et al. | 204/424 |
| 6,227,548 | B1 | * | 5/2001 | Netzer | 277/502 |
| 6,244,235 | B1 | * | 6/2001 | Hegemier et al. | 123/188.6 |
| 6,412,467 | B1 | * | 7/2002 | Leimer | 123/188.6 |

* cited by examiner

*Primary Examiner*—Gene Mancene
*Assistant Examiner*—Frederick C. Nicolas
(74) *Attorney, Agent, or Firm*—Rader, Fishman & Grauer PLLC

(57) ABSTRACT

A valve stem seal assembly for an internal combustion engine includes an elastomer seal body and a metal retainer adapted to hold the seal body in place over a valve guide. The circumferential seal body includes an aperture containing at least one radially inwardly directed sealing lip adapted to engage an engine valve stem to minimize escape of oil lubricant from the engine, particularly along a path between the valve guide and the reciprocally moving valve stem. The seal body contains an annular exterior groove adapted to receive an end wall in the upper extremity of the retainer. The retainer, formed of spring metal, comprises a cylindrical body containing a plurality of axially depending resilient fingers. The bottom extremities of the fingers have inwardly turned ends adapted to mechanically engage a circumferentially disposed groove or a step of a boss formed in the exterior cylindrical surface of the valve guide.

18 Claims, 1 Drawing Sheet

VALVE SEAL ASSEMBLY WITH SPRING FINGER RETAINER

BACKGROUND OF THE INVENTION

1. Field of Invention

The present invention relates to valve stem seal assemblies of the type installed over valve stems reciprocally movable within valve guides of internal combustion engines, and more particularly to seal assembly retainers incorporating specially designed retention fingers for securement of such assemblies to the valve guides.

2. Description of the Prior Art

Those skilled in the art will appreciate the manner in which intake and exhaust valves are employed in cylinder heads of internal combustion engines. Such valves, supported for reciprocal motion within valve guides, typically include integral elongated stems extending away from the engine cylinder heads, the ends of the stems interacting with rotating overhead cams for cyclic or repeated opening and closure of the valves against the force of valve return springs during the combustion cycle. Obviously, in order to permit unobstructed reciprocal movement of the stem in the guide, some mechanical clearance must exist between the valve guide and the moving stem. A plurality of valve stems thus move reciprocally to and from the cylinder head, each within its individual guide, and so-called valve stem seal assemblies are used to seal against leakage of oil through a mechanical clearance path between each annular engine valve guide and its associated valve stem.

As is well known, the intake port of a combustion chamber is opened and closed by the reciprocating motion of at least one intake valve, which in turn is driven by the rotary motion of a cam, the latter being affixed to and rotatable with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of similar construction, and both include stems integrally affixed to the valves.

In the typical engine, a valve stem seal assembly is fitted over or atop each valve guide, wherein each seal assembly includes a retainer frictionally mounted to an associated valve guide. Each valve stem seal assembly normally has two primary parts: 1) an elastomeric oil seal for controlling leakage of oil between the valve stem and guide as noted, and 2) a structural cylindrical retainer mounted atop of the valve guide to hold the oil seal in place.

While much progress has been achieved in valve stem seal design, performance, and construction, the installation and securement of valve seal assemblies remain areas in need of improvement. For example, in an original equipment assembly environment, there is need for improvement in feedback with respect to depth of insertion of the valve guide retainer onto the valve guide to assure proper installation. Many such retainers rely only on sliding friction for securement to valve guides. Others rely on barbs within the interior of the retainer to develop sufficient friction force for assuring adequate securement. Indicia, such as an audible click upon proper insertion, would be welcomed. In addition, a more secure mechanical retention of the assembly in the typically vibrating engine environment would be welcomed.

The valve stem seal retainer of the present invention addresses installation issues, and incorporates a positive mechanical coupling mechanism to assure proper retention of the valve stem seal assembly to valve guides.

SUMMARY OF THE INVENTION

The disclosed invention is a two-piece valve stem seal and retainer assembly for an internal combustion engine. A plurality of such assemblies is contemplated for use in an engine, each designed for insertion over an engine valve guide for continuous engagement with an associated reciprocally moveable valve stem. The elastomer seal body includes a circumferential aperture containing at least one radially inwardly directed sealing lip adapted to engage the stem to minimize the escape of oil lubricant from the engine, particularly along a path between the valve guide and the reciprocally moving valve stem seal.

In its preferred form, the seal body contains an annular groove adapted to receive an end wall in the upper extremity of the retainer. The retainer, formed of metal, comprises a cylindrical body containing a plurality of axially depending spring fingers. The bottom extremities of the fingers have inwardly turned ends adapted to mechanically engage a circumferentially disposed groove or step of a boss formed in the mating exterior cylindrical surface of an associated valve guide. In their preferred form, the fingers are provided in two alternate embodiments, each defining reverse bends for assuring resilient mechanical engagement with the valve guide. The first embodiment of the retainer, adapted to mechanically engage a circumferentially disposed groove in the guide, comprises a bowed cross-section at its lower guide-engaging end. Traversing downwardly along the retainer cross-section, each axially depending spring finger flares radially outwardly or away from the axially extending valve guide body, then bends radially inwardly toward the valve guide body, and finally reversibly upwardly, becoming parallel to the valve guide surface.

The second embodiment, adapted to engage a circumferentially disposed step of a boss on the guide, is without such a flare. Instead, at the bottom of its axial length, the cross-section of the second embodiment reverses its direction one hundred eighty degrees at its lowest extremity, thus becoming parallel to the body of the valve guide. The reverse bends of both embodiments impart a robust spring function to the mechanically engageable valve guide-connecting ends of the retainers. In each case, an audible click sound provides proof of proper securement upon installation. In addition, in both embodiments the connection mechanism is not only resilient, but also mechanically positive, and hence more reliable.

DETAILED DESCRIPTION OF PREFERRED EMBODIMENTS

Figure 1:
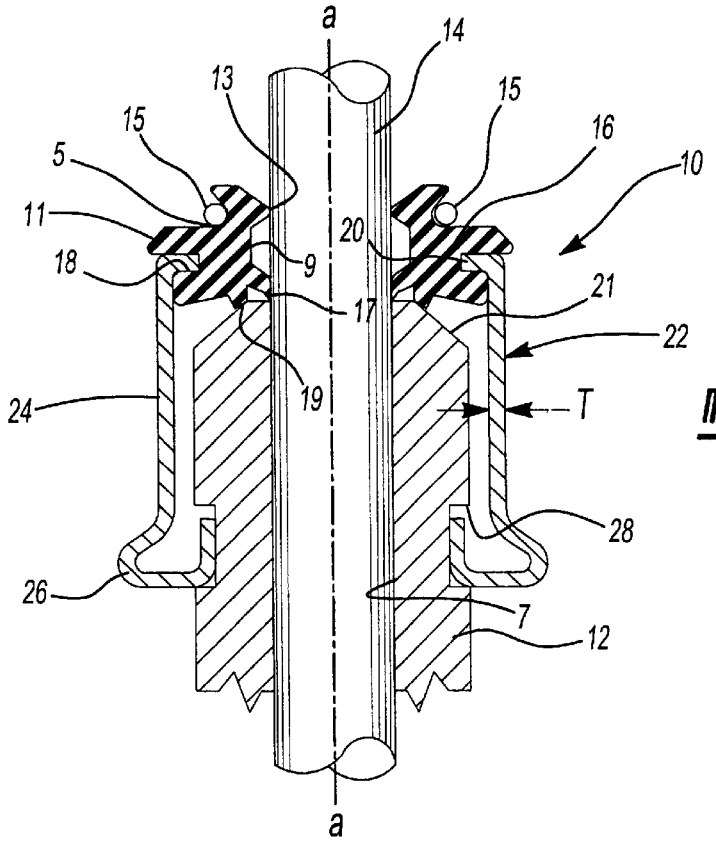
FIG. 1 is a cross-sectional view of one preferred embodiment of the present invention.

Referring initially to FIG. 1, a valve stem seal assembly 10 is mounted over an annular valve guide 12 fixed to a cylinder head deck (not shown) of an internal combustion engine (also not shown). A valve stem 14 is supported for reciprocal movement within the valve guide 12, the stem being positioned longitudinally (or vertically, as shown) along an axis a—a. The valve stem assembly 10 includes a resilient valve stem seal 16 adapted to sealingly engage an elongate valve stem 14. For this purpose, the seal 16 incorporates a circumferentially extending exterior groove 18 adapted for receipt of an annular end wall 20 of a cylindrical metallic valve seal retainer 22. Thus, the retainer 22 is adapted to retain and support the resilient seal 16 atop the valve guide 12.

The body of the seal 16 is generally annular in shape, preferably formed of an elastomeric material, and includes interior and exterior surfaces 9 and 11, respectively. Within its interior surface 9, the seal 16 includes a circumferentially extending primary sealing lip 13 adapted to engage the exterior circumferential surface of the stem 14 for limiting and or otherwise controlling movement of crankcase oil along a mechanical clearance path 7 between the stem 14 and the valve guide 12, for undesirable escape of oil into the combustion chamber, as will be appreciated by those skilled in the art. Via its exterior groove 18, the end wall 20 of the seal retainer 22, as shown, frictionally and circumferentially supports the seal 16. To enhance sealing effectiveness, a garter spring 15 is positioned within a groove 5 that encircles the exterior surface 11. The groove 5 is positioned radially outwardly of the primary sealing lip 13, and is hence in a position to impart a radial compression force against the lip 13, and ultimately against the reciprocally moving valve stem 14.

In the embodiment described herein, the valve stem seal assembly 10 further includes a secondary sealing lip 17 positioned in the lower circumferential interior surface 9 of the elastomeric seal 16. It will be appreciated by those skilled in the art that the primary sealing lip 13 and the secondary sealing lip 17 operate in concert to provide effective oil flow control between the valve stem 14 and the valve guide 12. A third sealing lip 19 depends vertically downwardly against a top of the valve guide 21 in the embodiment shown.

A plurality of axially depending fingers 24 extends downwardly from the annular end wall 20. In the preferred embodiment, each of the fingers 24 are circumferentially spaced about the guide 12, and each have a substantially uniform thickness or cross-section "T" throughout its entire length, including its arcuate ends 26. Each of the arcuate ends 26 of the fingers 24 is adapted for positive mechanical retention in a groove or slot 28 disposed circumferentially about the exterior of the guide. To the extent that the arcuate ends 26 share the same thickness "T" as the entire straight lengths of the fingers 24, the spring metal from which the retainer 22 is stamped may be from a sheet of uniform thickness for convenience of manufacture.

In the embodiment of FIG. 1, the arcuate end 26 of each finger 24 comprises an inwardly turned end at its bottom extremity, as shown. Those skilled in the art will appreciate that this first described embodiment of the retainer 22 comprises an outwardly bowed cross-section adapted to mechanically engage the circumferentially disposed groove 28 of the guide 12. Thus, traversing downwardly along the retainer cross-section from the end wall 20, each axially depending spring finger 24 flares radially outwardly away from the axially extending valve guide 12 at the arcuate end 26 thereof. The finger 24 then bends radially inwardly toward the valve guide body 12 and finally reverses upwardly, in a reverse-bend style, becoming parallel to the valve guide axis a—a.

It will be appreciated by those skilled in the art that installation of the valve stem seal assembly 10 is achieved via insertion of the assembly 10 downwardly over the top 21 of the valve guide 12. The arcuate ends 26 will be forced by the walls of the valve guide to flare radially outwardly. Upon reaching the slot 28, the spring resilience of the fingers 24 will cause the ends 26 to snap into the slot 28. It is contemplated that the snapping of the ends 26 into the slot 28 will not only be felt, but will be audible as well.

Figure 2:
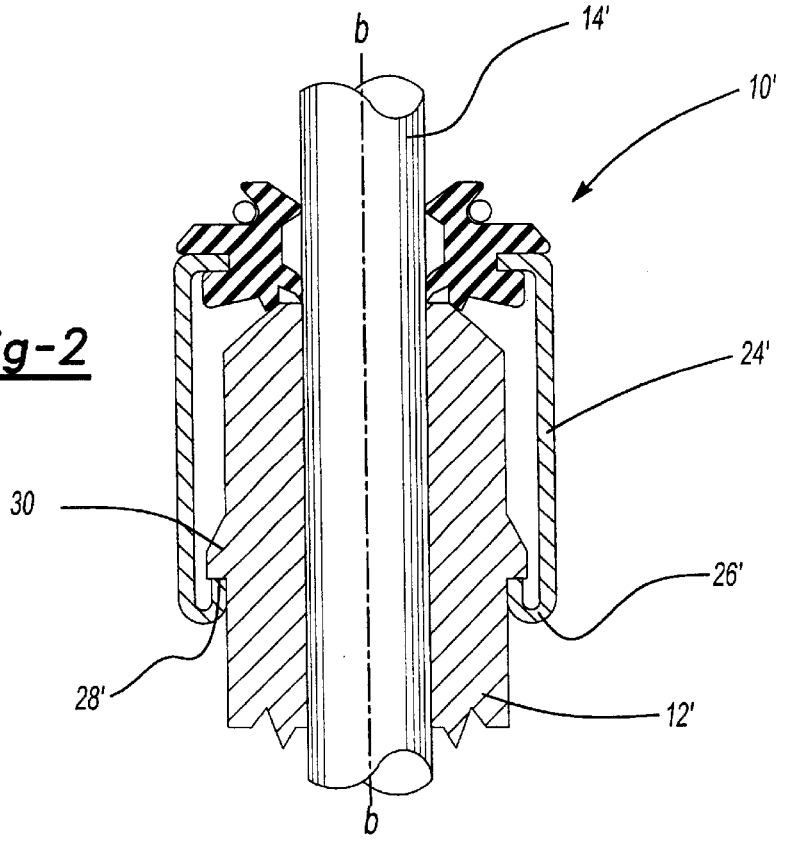
FIG. 2 is a cross-sectional view of a second preferred embodiment of the present invention

Referring now to FIG. 2, a second embodiment of a valve stem seal assembly 10' includes an alternate style of spring fingers 24'. For this embodiment, the valve guide incorporates a radially flared boss 30 which includes a circumferentially disposed step 28', as shown. All other aspects of the two embodiments remain the same.

The arcuate ends 26' of the spring fingers 24' are without the outward flare of the arcuate ends 26 of the embodiment of FIG. 1. Instead, at the bottom of its axially depending length, each end 26 defines a cross-section which reverses direction 180 degrees at its lowest extremity, thus becoming parallel to the body of the valve guide 12'. Installation of the second embodiment 10' is similar to that of the first embodiment 10, including an audible snap upon insertion, as will be appreciated by those skilled in the art. Moreover, the arcuate ends of both embodiments 26, 26' will impart a robust spring function to the mechanical coupling. Thus, the couplings will thus be desirably resilient, as well as mechanically positive.

It is to be understood that the above description is intended to be illustrative, and not limiting. Many embodiments will be apparent to those of skill in the art upon reading the above description. The scope of the invention should be determined, however, not with reference to the above description, but with reference to the appended claims and the full scope of equivalents to which the claims are entitled by law.

What is claimed is:

1. A valve stem assembly adapted for insertion over a valve guide and a reciprocally moveable valve stem supported in the guide, said seal assembly comprising a substantially cylindrical retainer having a longitudinal axis adapted for alignment with the valve stem and having a substantially uniform thickness throughout its length, said retainer having a radially oriented annular end wall integral therewith which defines and upper extremity substantially orthogonal to said axis;

the seal assembly further comprising an annular resilient valve stem seal adapted for sealingly engaging the valve stem, said valve stem seal having an exterior groove circumferentially disposed for engaging said annular end wall, whereby said seal is supported in said retainer;

said retainer further comprising a plurality of axially depending spring fingers defining a lower extremity of the retainer, wherein said fingers having arcuate ends adapted to extend radially inwardly to mechanically engage a receiving medium formed in an exterior surface of the guide;

wherein said arcuate ends of said seal retainer comprises a bowed cross-section defining a radially outwardly flared portion, and a return portion bent radially inwardly toward said guide, and a reversibly upwardly extending portion substantially parallel to said guide.

2. The valve stem seal assembly of claim 1 wherein said receiving medium for said arcuate ends comprises an annular slot circumferentially disposed about said valve guide.

3. The valve stem seal assembly of claim 1 wherein said seal retainer comprises a plurality of circumferentially disposed vertically oriented fingers, and wherein said arcuate ends of each of said fingers comprise a cross-section including a unitary reverse bend of 180 degrees.

4. The valve stem seal assembly of claim 3, wherein said receiving medium comprises a radially flared boss having an annular step at its lowest extremity, and wherein said arcuate end is received against said step.

5. The valve stem seal assembly of claim 1, wherein said resilient valve stem seal is formed of an elastomeric material.

6. The valve stem seal assembly of claim 5, wherein said retainer is formed of a spring metal material.

7. The valve stem seal assembly of claim 6, wherein upon installation of said seal assembly, said arcuate ends of said fingers produce an audible snap.

8. The valve stem seal assembly of claim 7, further comprising a secondary lip adapted for sealingly engaging said reciprocally movable valve stem seal.

9. The valve stem assembly of claim 8, further comprising a third lip, wherein said third lip engages said valve guide.

10. The valve stem seal, as in claim 1, wherein said return portion abuts the valve guide and engages said receiving medium.

11. The valve stem seal assembly, as in claim 10, wherein said reverse bend portion is substantially parallel to said longitudinal axis of said retainer.

12. The valve stem seal assembly, as in claim 11, wherein said receiving medium comprises an upper surface extending radially outwardly from the valve guide and being generally perpendicular to said axis of said retainer, said reverse bend portion is in contact with said upper surface when said fingers are engaged in said receiving medium.

13. The valve stem seal assembly, as in claim 12, wherein said upper surface is a step.

14. The valve stem seal assembly, as in claim 1, wherein said receiving medium comprises an upper surface extending radially outwardly from the valve guide and being generally perpendicular to said axis of said retainer.

15. The valve stem seal assembly, as in claim 14, wherein said upper surface is a step.

16. A valve stern seal assembly adapted for insertion over a valve guide and a reciprocally moveable valve stem supported in the guide, said seal assembly comprising a substantially cylindrical retainer having a longitudinal axis adapted for alignment with the valve stem, said retainer having a radially oriented annular end wall integral therewith which defines an upper extremity substantially orthogonal to said axis;

the seal assembly further comprising an annular resilient valve stem seal adapted for sealing engaging the valve stem, said valve stem seal having an exterior groove circumferentially disposed for engaging said annular end wall, whereby said seal is supported in said retainer;

said retainer further comprising a plurality of axially depending spring fingers defining a lower extremity of the retainer, wherein said fingers have arcuate ends adapted to extend radially inwardly to mechanically engage a receiving medium formed in an exterior surface of the guide, each of said arcuate ends having a reverse bend portion that abuts the valve guide and is substantially parallel to said longitudinal axis of said retainer;

said receiving medium comprises an upper surface extending radially outwardly from the valve guide and being generally perpendicular to said axis of said retainer, said reverse bend portion contacts said upper surface when said fingers are engaged in said receiving medium.

17. The valve stem seal assembly, as in claim 16, wherein said upper surface is a step.

18. The valve stem seal assembly, as in claim 16, wherein to disengage said finger from said receiving medium said reverse bend portion must be moved radially outwardly away from said valve guide to clear said upper surface.

* * * * *